US007699640B2

(12) United States Patent
Brekosky et al.

(10) Patent No.: US 7,699,640 B2
(45) Date of Patent: Apr. 20, 2010

(54) MINIATURE CIRCULAR CONNECTOR SYSTEM

(75) Inventors: Lawrence John Brekosky, Dillsburg, PA (US); Keith Edwin Miller, Manheim, PA (US)

(73) Assignee: Tyco Electronics Corporation, Middletown, PA (US)

( * ) Notice: Subject to any disclaimer, the term of this patent is extended or adjusted under 35 U.S.C. 154(b) by 82 days.

(21) Appl. No.: 11/565,813

(22) Filed: Dec. 1, 2006

(65) Prior Publication Data

US 2008/0132122 A1 Jun. 5, 2008

(51) Int. Cl.
*H01R 13/627* (2006.01)

(52) U.S. Cl. ..... 439/350; 439/95; 439/101

(58) Field of Classification Search ..... 439/350, 439/354, 607, 660, 270, 95, 101, 108, 939
See application file for complete search history.

(56) References Cited

U.S. PATENT DOCUMENTS 3,336,562 A * 8/1967 Mccormick et al. ..... 439/155
3,594,694 A * 7/1971 Clark ..... 439/131
4,261,628 A * 4/1981 Gallagher et al. ..... 439/95
4,316,647 A 2/1982 Bailey et al.
4,493,525 A 1/1985 Hall et al.
5,478,254 A * 12/1995 Holt ..... 439/275
5,865,646 A 2/1999 Ortega et al.
6,027,375 A 2/2000 Wu
6,595,801 B1 7/2003 Leonard et al.

OTHER PUBLICATIONS

International Search Report; International Application No. PCT/US2007/024329; International Filing Date Nov. 21, 2007.

* cited by examiner

*Primary Examiner*—Tulsidas C Patel
*Assistant Examiner*—Travis Chambers

(57) ABSTRACT

A generally circular plug and receptacle connector system for use with electronic systems and devices is provided. This system includes: a plug component and a receptacle component. The plug component further includes: a housing having an internal channel formed therein for receiving a length of stripped wire; a shielded conduit attached to the housing, wherein the shielded conduit further includes a chamber formed therein; a plug body disposed within the shielded chamber; and a plurality of conductive pins disposed within the plug body, wherein the conductive pins are adapted on one end to be coupled with the length of stripped wire. The receptacle component further includes: a housing having a shielded chamber formed therein; a flanged member disposed within the housing for connecting to the plug component; a receptacle body disposed with within the shielded chamber; and a plurality of conductive sockets disposed within the receptacle body, wherein the conductive sockets of the receptacle component are adapted to mate with the conductive pins of the plug component.

16 Claims, 5 Drawing Sheets

MINIATURE CIRCULAR CONNECTOR SYSTEM

BACKGROUND OF THE INVENTION

The described invention relates in general to a connector system for use with electronic devices, and more specifically to a miniature circular connector system for use in connecting one electronic system or device to another electronic system or device.

Miniature circular connectors are used in the field of electronic for devices such as handheld PCs, scanners, portable instruments, medical monitors, and numerous other applications. Most commercially available miniature circular connectors include plastic components and are unshielded, making their use somewhat limited. Shielded connectors are typically very costly because they include multiple plastic, plated, and/or metal die cast components. Thus, because certain applications require shielded connectors, there is an ongoing need for an inexpensive, shielded connector that is compatible with numerous electronic systems and devices, including those listed above.

SUMMARY OF THE INVENTION

The following provides a summary of exemplary embodiments of the present invention. This summary is not an extensive overview and is not intended to identify key or critical aspects or elements of the present invention or to delineate its scope.

In accordance with one aspect of the present invention, a connector system for use with electronic systems and devices is provided. This system includes a plug component and a receptacle component. The plug component further includes: a housing having an internal channel formed therein for receiving a length of stripped wire; a shielded conduit attached to the housing, wherein the shielded conduit further includes a chamber formed therein; a plug body disposed within the shielded chamber; and a plurality of conductive pins disposed within the plug body, wherein the conductive pins are adapted on one end to be coupled with the length of stripped wire. The receptacle component further includes: a housing having a shielded chamber formed therein; a flanged member disposed within the housing for connecting to the plug component; a receptacle body disposed within the shielded chamber; and a plurality of conductive sockets disposed within the receptacle body, wherein the conductive sockets of the receptacle component are adapted to mate with the conductive pins of the plug component.

In accordance with another aspect of the present invention, a miniaturized circular connector for use with electronic systems is provided. This system includes a plug component and a receptacle component. The plug component further includes: a housing having an internal channel formed therein for receiving a length of stripped wire; a shielded conduit attached to the housing, wherein the shielded conduit further includes a clip attached to the exterior thereof and a chamber formed therein; a plug body disposed within the shielded chamber; and a plurality of conductive pins disposed within the plug body, wherein the conductive pins are adapted on one end to be coupled with the length of stripped wire. The receptacle component further includes: a housing having a shielded chamber formed therein; a flanged member disposed within the housing, wherein the flanged member is adapted to receive the clip attached to the exterior of the shielded conduit of the plug component; a receptacle body disposed within the shielded chamber; and a plurality of conductive sockets disposed within the receptacle body, wherein the conductive sockets of the receptacle component are adapted to mate with the conductive pins of the plug component.

In yet another aspect of this invention, a method for connecting electronic components to one another is provided. This method includes: providing a plug component, wherein the plug component further includes: a shielded conduit, wherein the shielded conduit further includes a chamber formed therein; a plug body disposed within the shielded chamber; and a plurality of conductive pins disposed within the plug body, wherein the conductive pins are adapted on one end to be coupled with the length of stripped wire; attaching a length of stripped wire to the conductive pins within the plug body; enclosing the length of stripped wire and a portion of the shielded conduit within a housing; and inserting the plug component into a receptacle component. The receptacle component further includes: a housing having a shielded chamber formed therein; a flanged member disposed within the housing, wherein the flanged member is adapted to receive the clip attached to the exterior of the shielded conduit of the plug component; a receptacle body disposed within the shielded chamber; and a plurality of conductive sockets disposed within the receptacle body, wherein the conductive sockets of the receptacle component are adapted to mate with the conductive pins of the plug component, and wherein a length of stripped wire has been attached to the conductive sockets within the receptacle body.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
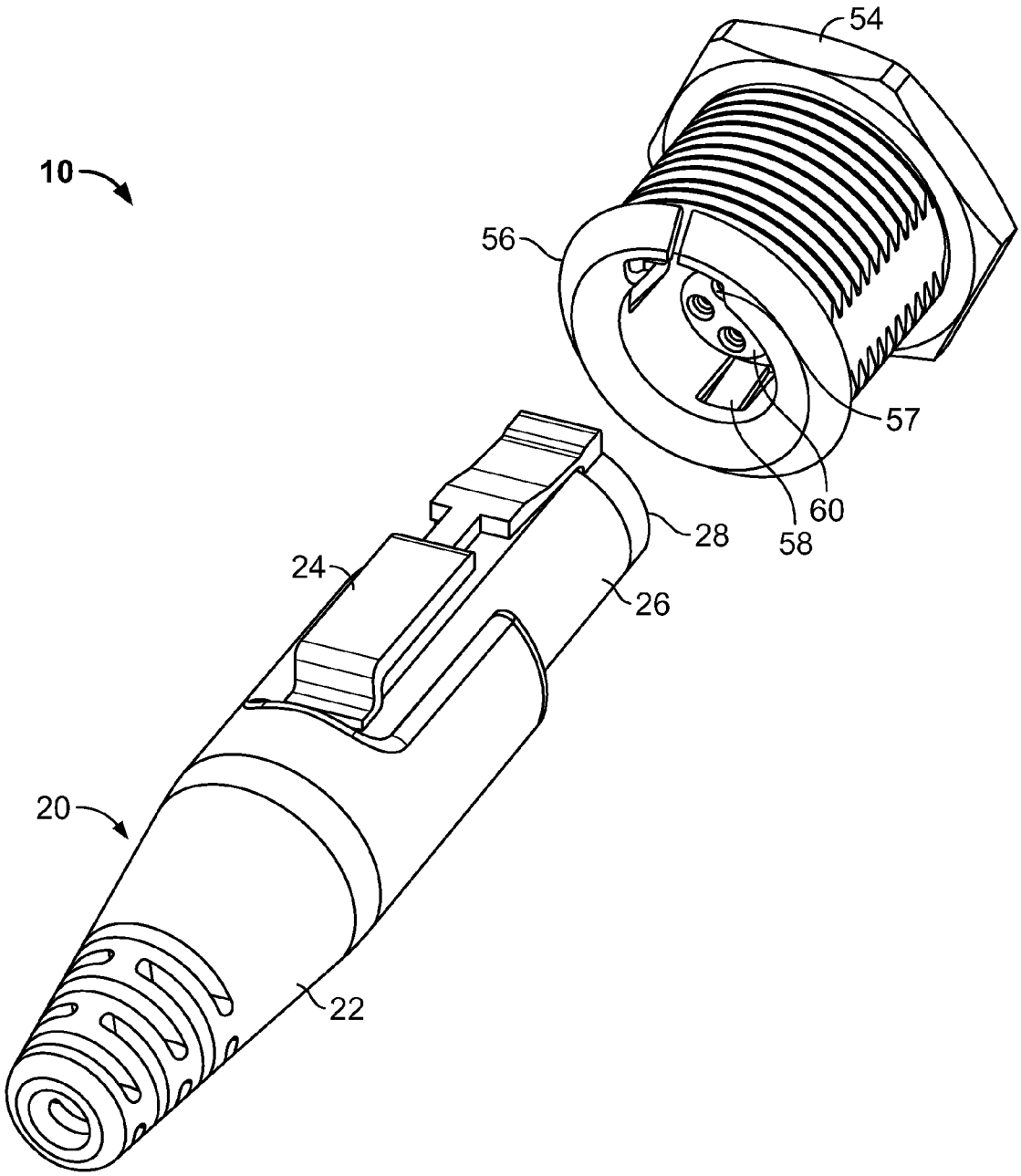
FIG. 1 is an exploded perspective view of an exemplary embodiment of the miniature circular connector of the present invention.
Figure 2:
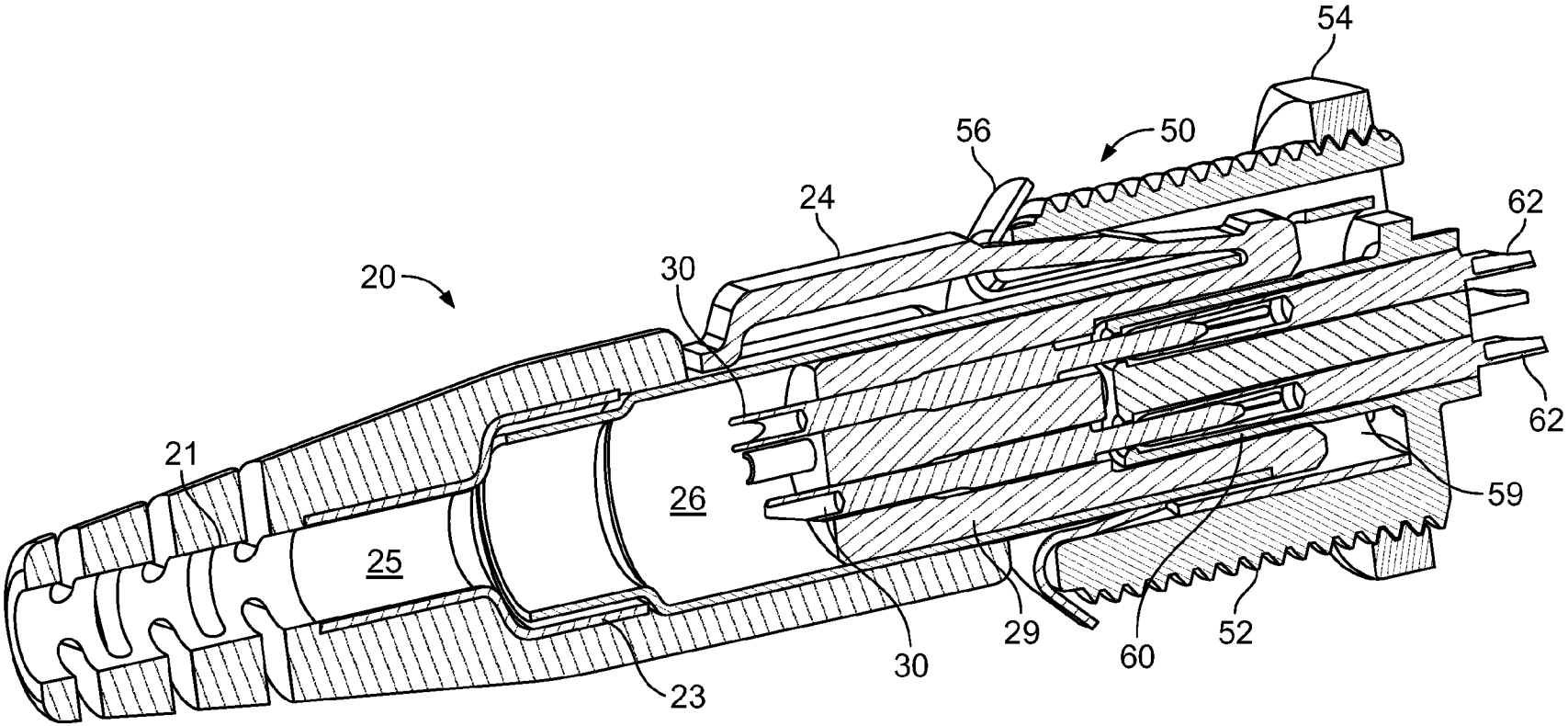
FIG. 2 is a cross-sectional view of the miniature circular connector of FIG. 1, shown in its assembled state.
Figure 3:
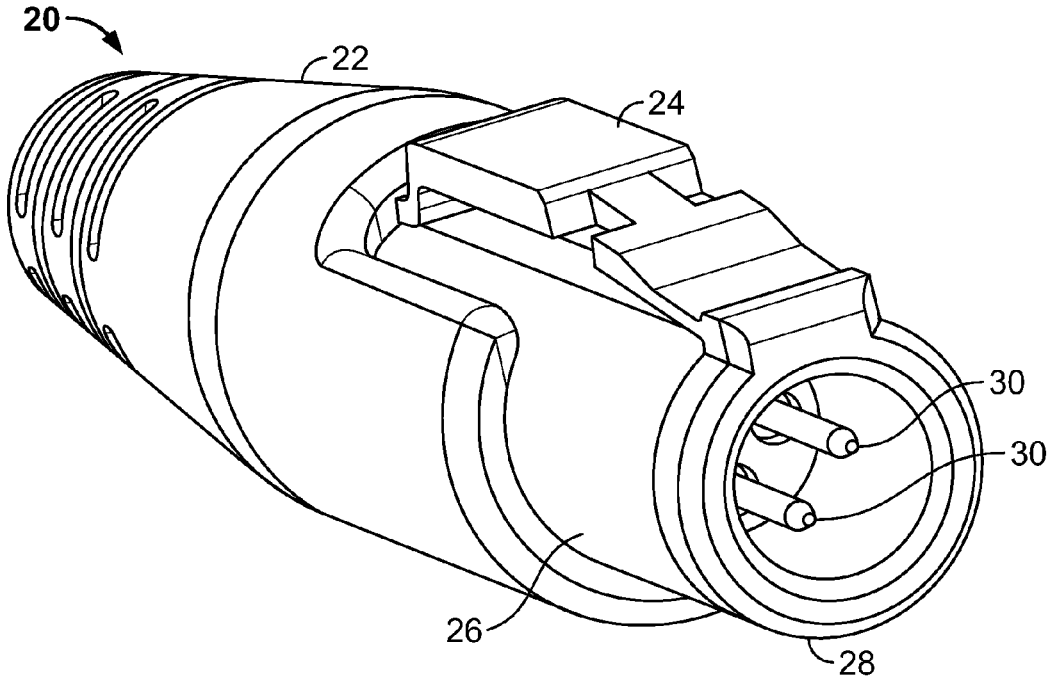
FIG. 3 is a rear perspective view of the plug component of the miniature circular connector system of FIG. 1.
Figure 4:
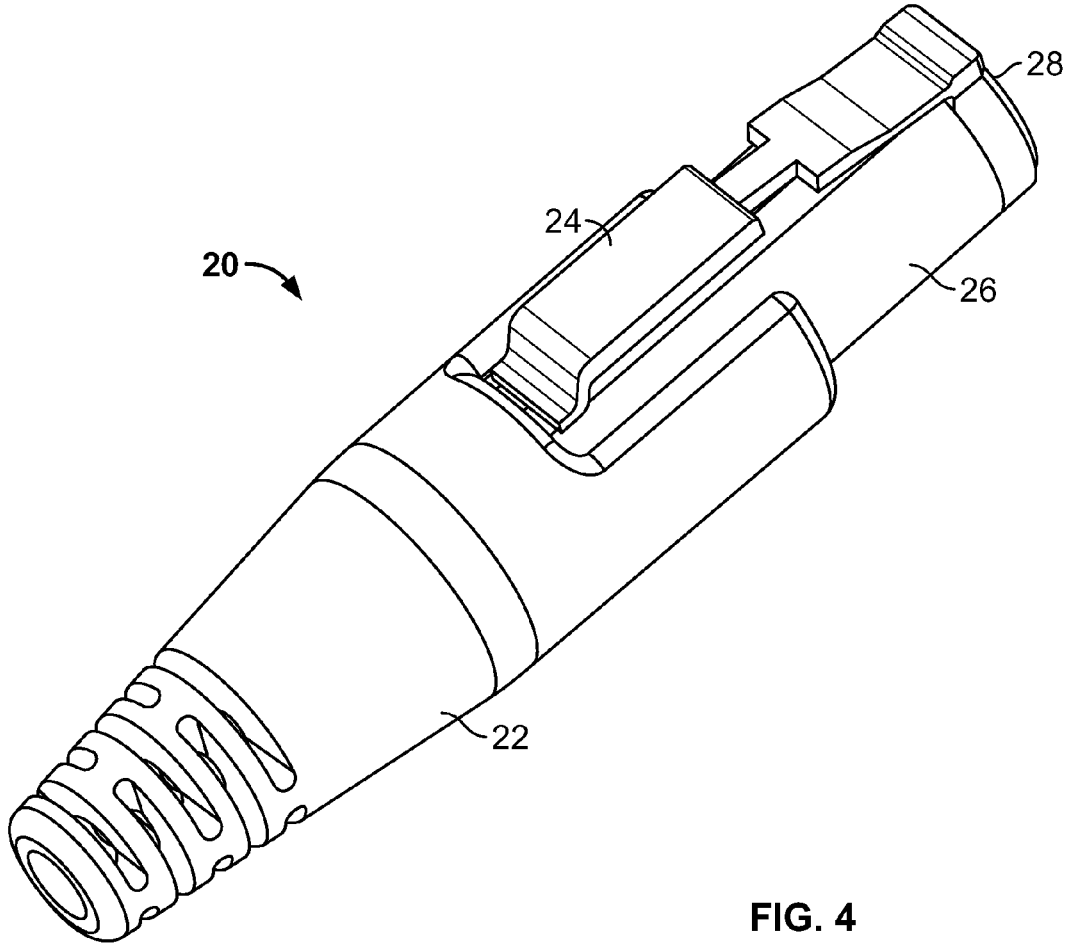
FIG. 4 is a top perspective view of the plug component of the miniature circular connector system of FIG. 1.
Figure 5:
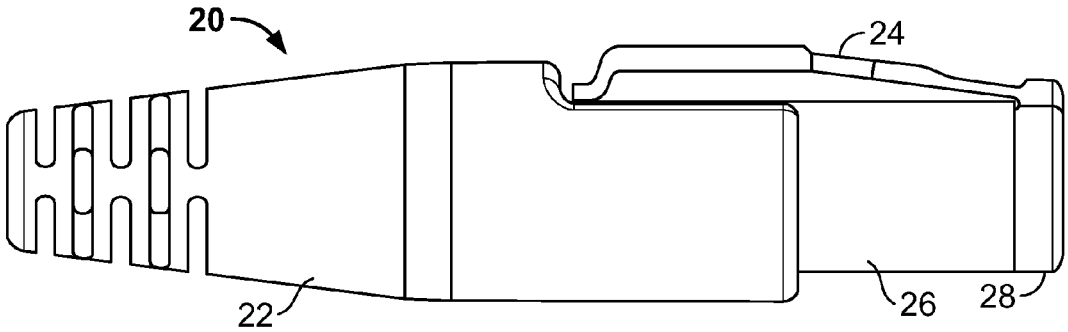
FIG. 5 is a side view of the plug component of the miniature circular connector system of FIG. 1.
Figure 6:
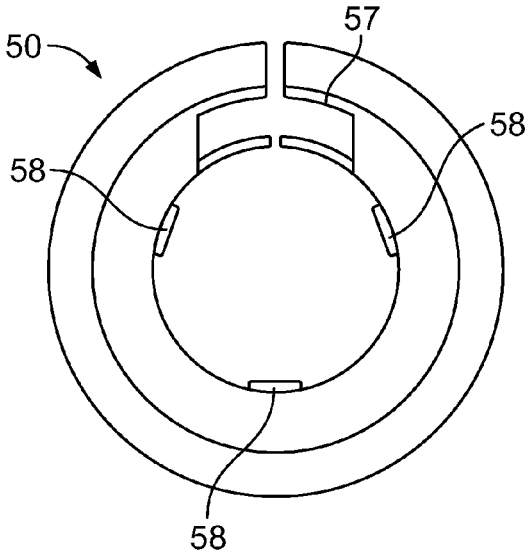
FIGS. 6-8 are front, side, and perspective views respectively of the receptacle component of the miniature circular connector system of FIG. 1.
Figure 7:
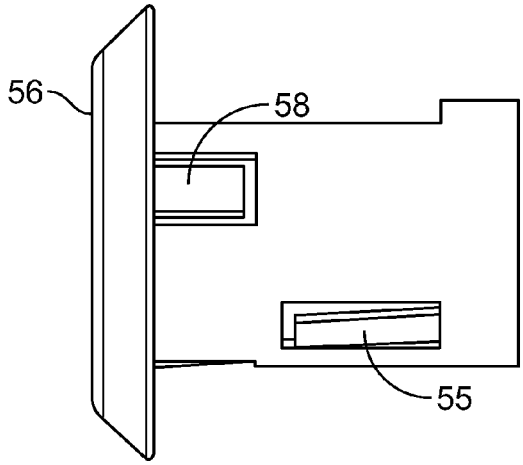
Figure 8:
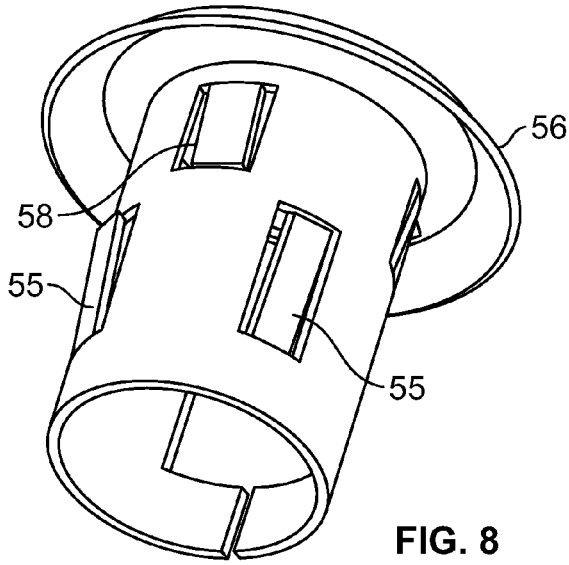

Exemplary embodiments of the present invention are now described with reference to the figures. Reference numerals are used throughout the detailed description to refer to the various elements and structures. In other instances, well-known structures and devices are shown in block diagram form for purposes of simplifying the description. Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to connectors used with electronics and provides a low-cost device that includes stamped and formed metal components for shielding. An exemplary embodiment of this invention provides a circular plug and receptacle connector system for use with electronic systems and devices. This system includes: a plug component and a receptacle component. The plug component further includes: a housing having an internal channel formed therein for receiving a length of stripped wire; a shielded conduit attached to the housing, wherein the shielded conduit further includes a chamber formed therein; a plug body disposed within the shielded chamber; and a plurality of conductive pins disposed within the plug body, wherein the conductive pins are adapted on one end to be coupled with the length of stripped wire. The receptacle component further includes: a housing having a shielded chamber formed therein; a flanged connector disposed within the housing for connecting to the plug component; a receptacle body disposed within the shielded chamber; and a plurality of conductive pins disposed within the receptacle body, wherein the conductive pins of the receptacle component are adapted to mate with the conductive pins of the plug component.

With reference now to the figures, FIGS. 1-5 provide multiple views of an exemplary embodiment of the connector system of the present invention. As shown in the figures, connector system 10 includes plug component 20 and receptacle component 50 into which plug component 20 is inserted. In this embodiment, both components are generally cylindrical. Plug component 20 includes an internal channel 21, and a crimp metal ferrule 25, which is adapted to receive a wire or cable. An external housing 22, which is typically molded plastic, includes an internal chamber 23 and an external, "spring-loaded" clip 24 for engaging receptacle component 50 and securing the plug component therein. A collar 28 is formed at the end of clip 24 and encircles the end of plug component 20 that is inserted into receptacle component 50. Shielded conduit 26 is positioned within internal chamber 23 and plug body 29, which includes electrically conductive plug pins 30, is mounted within the shielded conduit. Shielded conduit 26 is also in contact with ferrule 25. This contact allows the ground from the cable to be carried though shielded conduit 26.

As best shown in FIGS. 1-2 and 6-8, an exemplary receptacle component 50 includes an external housing 52, the exterior portion of which is typically threaded. A hex nut 54 or other attachment device or means may be threaded onto housing 52 for securing receptacle component 50 within or against a panel or other surface. A flanged member 56, which includes ground fingers 55, notch 57, and latch fingers 58, encircles housing 52 and is formed integrally with shielded chamber 59, which extends through the length of housing 52. Receptacle body 60, which includes receptacle sockets 62, is mounted within shielded chamber 59. When plug component 20 is inserted into receptacle component 50, plug pins 30 are inserted into and engage receptacle sockets 62. Latch fingers 58 engage shielded conduit 26, thereby enabling shielded electrical communication between plug component 20 and receptacle component 50. At least one ground finger 55 also engages shielded conduit 26 for conducting the ground from a cable to flanged member 56 and on to a panel into which receptacle component 50 has been inserted (see description below).

Figure 9:
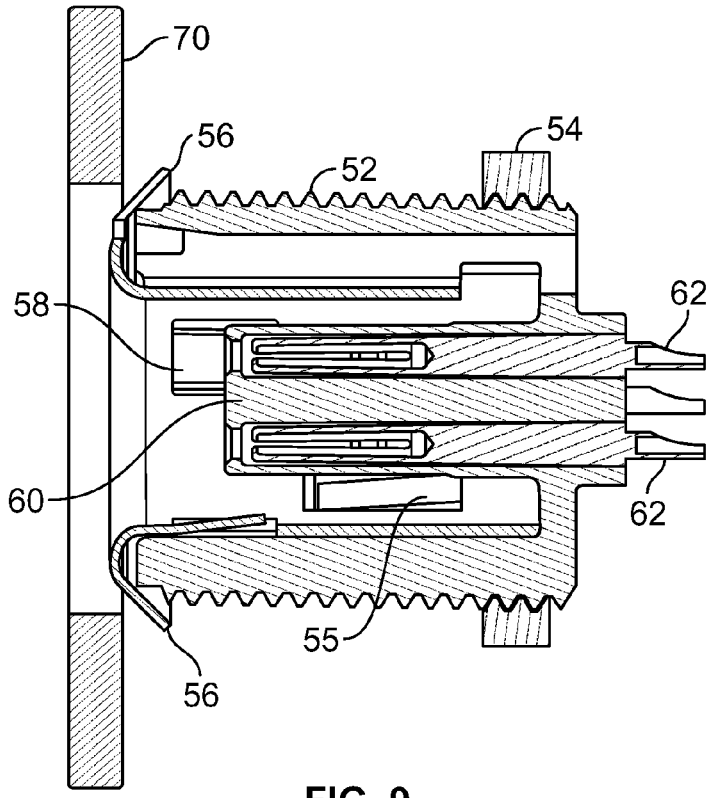
FIGS. 9-10 are side cross-sectional views of the receptacle component of the miniature circular connector system of FIG. 1 prior to and following insertion of the receptacle component into a panel.
Figure 10:
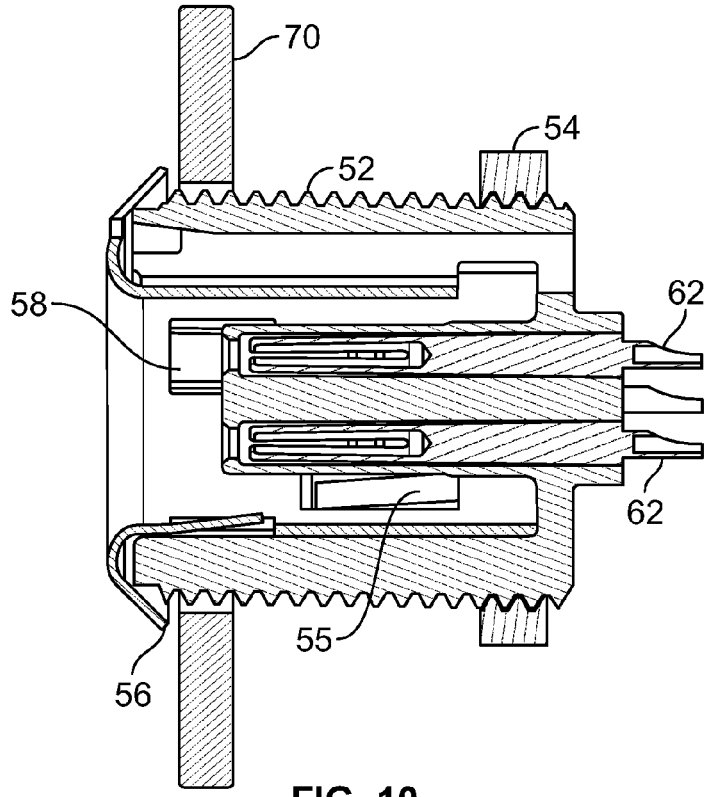

Connector system 10 may be used by stripping one end of a length of wire and attaching the stripped end to plug pins 30, which are adapted to receive stripped wire. Once attached, the stripped wire and plug pins 30 are enclosed within shielded conduit 26 and within housing 22. Similarly, a length of wire, stripped at one end, is attached to receptacle sockets 62 on receptacle component 50. Plug component 20 is then inserted into receptacle component 50 until clip 24 and shielded conduit 26 engages ground fingers 55, notch 57 and latch fingers 58. The components of connector system 10 may be disengaged by grasping each component and applying firm pressure until the components separate. Receptacle component 50 is typically inserted into a panel or the like, and as shown in FIGS. 9-10, flanged member 56 compresses in a spring-like manner as it is being inserted into panel 70 and expands once it is fully inserted.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A connector system for use with electronic systems and devices, comprising:

(a) a plug component, wherein the plug component further includes:

(i) a housing having an internal channel formed therein;

(ii) a shielded conduit connected to and partially disposed within the housing, wherein the shielded conduit further includes a chamber formed therein;

(iii) a crimp ferrule disposed within the housing for receiving a length of wire, wherein the crimp ferrule is in contact with the shielded conduit;

(iv) a collar attached to and encircling one end of the shielded conduit, wherein the collar further includes a spring-loaded clip formed therewith, and wherein the clip extends lengthwise over a portion of the shielded conduit and terminates proximate the housing;

(v) a plug body disposed within the shielded conduit; and (vi) a plurality of conductive pins disposed within the plug body, wherein the conductive pins are adapted on one end to be coupled with the length of stripped wire; and (b) a receptacle component configured to mate with the plug component, wherein the receptacle component further includes:

(i) a housing having a shielded chamber formed therein;

(ii) a flanged member disposed within the housing, wherein a portion of the flanged member is configured to receive the clip attached to the collar of the plug component, and wherein the clip is urged against the flanged member when the plug component and receptacle component are mated for forming a secure connection therebetween;

(iii) a receptacle body disposed within the shielded chamber; and (iv) a plurality of conductive sockets disposed within the receptacle body, wherein the conductive sockets of the receptacle component are adapted to mate with the conductive pins of the plug component.

2. The connector system of claim 1, wherein the flanged member further includes at least one latching member and at least one grounding member formed thereon, wherein the at least one latching member and the at least one grounding member engages the shielded conduit of the plug component and enable shielded and grounded electrical communication between the plug component and the receptacle component.

3. The connector system of claim 1, wherein the plug component housing further comprises a single piece of molded plastic.

4. The connector system of claim 1, wherein each of the plug component and the receptacle component further comprise a length of wire attached thereto.

5. The connector system of claim 1, wherein the exterior of the receptacle component housing is threaded.

6. The connector system of claim 5, wherein the receptacle component further comprises a nut, and wherein the nut attaches to the threaded exterior of the receptacle housing.

7. A miniaturized circular connector for use with electronic systems, comprising:

(a) a plug component, wherein the plug component further includes:

(i) a housing having an internal channel formed therein for receiving a length of stripped wire;

(ii) a shielded conduit attached to and partially disposed within the housing, wherein the shielded conduit further includes a chamber formed therein;

(iii) a crimp ferrule disposed within the housing for receiving a length of wire, wherein the crimp ferrule is in contact with the shielded conduit;

(iv) a collar attached to and encircling one end of the shielded conduit, wherein the collar further includes a clip formed therewith, and wherein the clip extends lengthwise over a portion of the shielded conduit and terminates proximate the housing;

(v) a plug body disposed within the shielded conduit; and (vi) a plurality of conductive pins disposed within the plug body, wherein the conductive pins are adapted on one end to be coupled with the length of stripped wire; and (b) a receptacle component adapted to mate with the plug component, wherein the receptacle component further includes:

(i) a housing having a shielded chamber formed therein;

(ii) a flanged member disposed within the housing, wherein a portion of the flanged member is configured to receive the clip attached to the collar of the plug component, wherein the clip is urged against the flanged member when the plug component and receptacle component are mated to form a secure connection therebetween, and wherein the flanged member further includes at least one latching member and at least one grounding member formed thereon, wherein the at least one latching member and the at least one grounding member engage the shielded conduit of the plug component and enable shielded and grounded electrical communication between the plug component and the receptacle component; and (iii) a receptacle body disposed within the shielded chamber; and (iv) a plurality of conductive sockets disposed within the receptacle body, wherein the conductive sockets of the receptacle component are adapted to mate with the conductive pins of the plug component.

8. The connector of claim 7, wherein the plug component housing further comprises a single piece of molded plastic.

9. The connector of claim 7 wherein each of the plug component and the receptacle component further comprise a length of wire attached thereto.

10. The connector of claim 7, wherein the exterior of the receptacle component housing is threaded.

11. The connector of claim 10, wherein the receptacle component further comprises a nut, and wherein the nut attaches to the threaded exterior of the receptacle housing.

12. A method for connecting electronic components to one another, comprising:

(a) providing a plug component, wherein the plug component further includes:

(i) a housing having an internal channel formed therein;

(ii) a shielded conduit connected to and partially disposed within the housing, wherein the shielded conduit further includes a chamber formed therein;

(iii) a crimp ferrule disposed within the housing for receiving a length of wire, wherein the crimp ferrule is in contact with the shielded conduit;

(iv) a collar attached to and encircling one end of the shielded conduit, wherein the collar further includes a clip formed therewith, and wherein the clip extends lengthwise over a portion of the shielded conduit and terminates proximate the housing;

(v) a plug body disposed within the shielded conduit; and (vi) a plurality of conductive pins disposed within the plug body, wherein the conductive pins are adapted on one end to be coupled with a length of stripped wire; and (b) attaching a length of stripped wire to the conductive pins within the plug body;

(c) enclosing the length of stripped wire and a portion of the shielded conduit within the crimp ferrule, and (d) mating the plug component with a receptacle component by inserting the plug component into the receptacle component, wherein the receptacle component further includes:

(i) a housing having a shielded chamber formed therein;

(ii) a flanged member disposed within the housing, wherein a portion of the flanged member is configured to receive the clip attached to the collar of the plug component, and wherein the clip is urged against the flanged member when the plug component and receptacle component are mated for forming a secure connection therebetween;

(iii) a receptacle body disposed within the shielded chamber; and (iv) a plurality of conductive sockets disposed within the receptacle body, wherein the conductive sockets of the receptacle component are adapted to mate with the conductive pins of the plug component, and wherein a length of stripped wire has been attached to the conductive sockets within the receptacle body.

13. The method of claim 12, wherein the housing enclosing the length of stripped wire and a portion of the shielded conduit further comprises a single piece of molded plastic.

14. The method of claim 12, wherein the flanged member further includes at least one latching member and at least one grounding member formed thereon, wherein the at least one latching member and the at least one grounding member engages the shielded conduit of the plug component and enable shielded and grounded electrical communication between the plug component and the receptacle component.

15. The method of claim 12, wherein the exterior of the receptacle component housing is threaded.

16. The method of claim 15, wherein the receptacle component further comprises a nut, and wherein the nut attaches to the threaded exterior of the receptacle housing.

* * * * *